US009375077B2

(12) United States Patent
Kumpf

(10) Patent No.: US 9,375,077 B2
(45) Date of Patent: Jun. 28, 2016

(54) APPARATUS FOR THE PRODUCTION OF BRUSHES OR BRISTLED-WARES AND BRUSH OR BRISTLED-WARES

(71) Applicant: Zahoransky AG, Todtnau (DE)

(72) Inventor: Ingo Kumpf, Todtnau (DE)

(73) Assignee: Zahoransky AG, Todtnau (DE)

( * ) Notice: Subject to any disclaimer, the term of this patent is extended or adjusted under 35 U.S.C. 154(b) by 540 days.

(21) Appl. No.: 13/832,950

(22) Filed: Mar. 15, 2013

(65) Prior Publication Data

US 2013/0241267 A1 Sep. 19, 2013

(30) Foreign Application Priority Data

Mar. 19, 2012 (DE) ..... 10 2012 005 311

(51) Int. Cl.

| | |
|---|---|
| ***A46D 3/00*** | (2006.01) |
| ***A46D 3/04*** | (2006.01) |
| *A46B 3/06* | (2006.01) |

(52) U.S. Cl.

CPC *A46D 3/045* (2013.01); *A46D 3/00* (2013.01); *A46B 3/06* (2013.01); *A46D 3/005* (2013.01)

(58) Field of Classification Search

CPC ..... A46D 3/045; A46D 3/00

See application file for complete search history.

(56) References Cited

FOREIGN PATENT DOCUMENTS

| | | |
|---|---|---|
| DE | 3712962 | * 11/1988 |
| EP | 0 472 863 | * 3/1992 |
| EP | 2078472 | 2/2010 |

* cited by examiner

*Primary Examiner* — Randall Chin

(74) *Attorney, Agent, or Firm* — Volpe and Koenig, P.C.

(57) ABSTRACT

In an apparatus (1*a*) for the production of brushes or bristled-wares (9) having bristle bundles (3) melted at a fastening-side end, a reception sleeve (2) made from silica glass, crystal glass, glass ceramic and/or an alloy thereof for the positive, at least regional reception of a bristle bundle (3), on the one hand, and of a functional part (4) arranged, in the bristle longitudinal direction, behind its fastening-side end, on the other hand, are provided. Action elements (6) for acting upon the free ends of the bristle bundle (3) and of the functional part (4) and for acting with force upon the bristle bundle (3) and/or the functional part (4) in the bristle longitudinal direction, a heating device (7), arranged outside the reception sleeve (2), for heating the mutually confronting ends of the bristle bundle (3) and of the functional part (4) and for melting on the bristle bundle (3) and a cooling device (8), arranged outside the reception sleeve (2), for cooling the previously melted-on bristle bundle (3) are provided (FIG. 3).

8 Claims, 4 Drawing Sheets

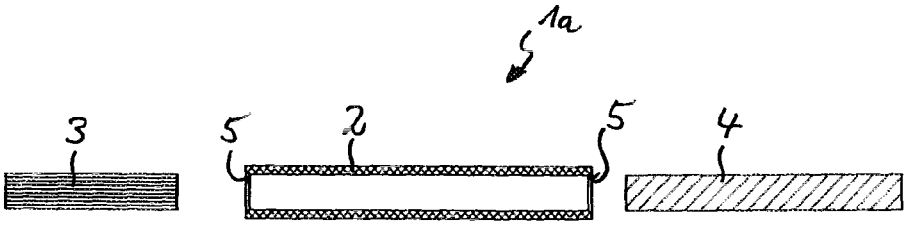
Fig. 1
Fig. 2
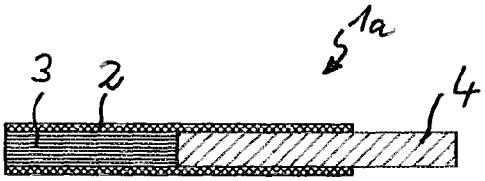
Fig. 3
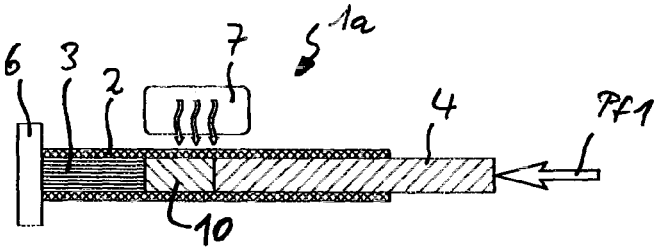
Fig. 4
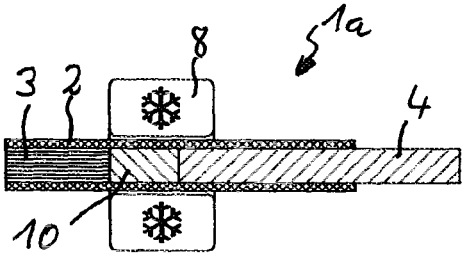
Fig. 5
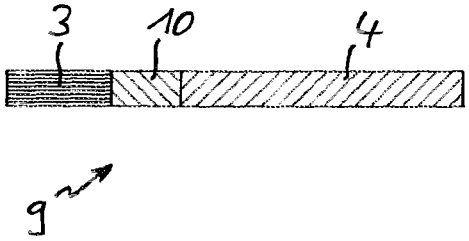

APPARATUS FOR THE PRODUCTION OF BRUSHES OR BRISTLED-WARES AND BRUSH OR BRISTLED-WARES

INCORPORATION BY REFERENCE

The following documents are incorporated herein by reference as if fully set forth: German Patent Application No. DE 102012005311.8, filed Mar. 19, 2012.

BACKGROUND

The invention relates to an apparatus and a method for the production of brushes or bristled-wares having bristle bundles melted at a fastening-side end.

In the production of brushes or bristled-wares, in which the bristle bundles are to be melted together at a fastening-side end, the fastening-side ends are usually acted upon by a heating plate in order melt the bristle material. When the heating plate is withdrawn, however, melted-on bristle material can adhere to the heating plate, and this may lead to undesirable malformations on the brush or bristled-ware. An apparatus is known from EP 2 078 472 B1 in which the bristle bundles, after being melted by a heating ram, are acted upon by a further ram in order to press the melt-on points flat until they cool and to avoid adhesions on the ram. This, however, is complicated and therefore costly.

If bristle bundles are to be connected to a further part by being melted, a laterally expanding bead of molten plastic material occurs in the connection region by the heated and melted-on bundles being pressed down onto the part, thus resulting in an ugly appearance and often being undesirable on the finished product.

Moreover, by the bristle material being melted using a metal plate, an unpleasant and possibly harmful plastic smell often occurs.

SUMMARY

The object is, therefore, to provide an apparatus of the type initially mentioned, in which adhesions and/or protuberances are avoided and which can be implemented in a structurally simple way.

In the solution according to the invention, a reception sleeve made from silica glass, glass ceramic and/or an alloy thereof is provided for the positive, at least regional reception of a bristle bundle, on the one hand, and of a functional part arranged behind its fastening-side end in the bristle longitudinal direction, on the other hand, action elements for acting upon the free ends of the bristle bundle and the functional part and for acting with force upon the bristle bundle and/or functional part in the bristle longitudinal direction are provided, and a heating device, arranged outside the reception sleeve, for heating the mutually confronting ends of the bristle bundle and of the functional part and for melting on the bristle bundle and a cooling device, arranged outside the reception sleeve, for cooling the previously melted-on bristle bundle are provided.

By heat being supplied through the reception sleeve, the bristle bundles arranged therein are melted, and, by the bristle bundles and functional part simultaneously being pressed one onto the other, these two parts are connected to one another. By at least those ends of the bristle bundle and of the functional part which are to be connected to one another being arranged inside the reception sleeve, the melted-on plastic material cannot spread out beyond the inner contour of the reception sleeve which corresponds to the outer contour of the bristle bundle, so that the occurrence of a bead is reliably avoided. By the reception sleeve and the bristle bundle located therein being subsequently cooled, the plastic material is cooled again until it is cured.

The use of silica glass, glass ceramic and/or an alloy thereof for the reception sleeve affords good heat conductivity, so that the transfer of the thermal energy of the heating device, and cooling by the cooling device can take place efficiently, largely free of loss, into the inner cavity of the reception sleeve to the bristle bundle and functional part located there.

Moreover, silica glass has high chemical resistance. Also, it is advantageous that a reception sleeve made from said material has a smooth pore-free surface to which melted-on plastic material does not adhere. Depending on the nature of the material of the reception sleeve, the latter has a neutral or even negative coefficient of expansion, so that, during the cooling phase, the plastic even additionally comes loose from the reception sleeve. This ensures that the bristle bundle with the functional part fastened to it is released in a simple way.

Furthermore, the heating of the plastic material via the reception sleeve comprised of silica glass, glass ceramic and/or an alloy thereof avoids the occurrence of unpleasant plastic smells during the melting-on operation.

The functional part may be comprised, in particular, of plastic, wood or metal. When plastic is used, this, too, can also be melted during heating, so that an especially good connection between the functional part and bristle bundle is obtained.

The functional part may in this case be a stick, a drill, a compression spring or a screw. A stick may serve as a grip for a paintbrush-like bristled-ware. If the bristle bundle is connected to a drill, the bristled-ware can be attached to a drilling machine and be used, for example, as a grinding element. A screw as the functional part makes it possible to connect the bristled-ware releasably to a separate bristle carrier. In this case, the functional part may also have a broadened screw head with a hexagon. The end face of the reception sleeve is in this case attached to the flat side of the screw head in order to connect the functional part to the bristle bundle.

In order to keep the bristled-ware under pressure in contact with a surface, the functional part may be a compression spring. Other embodiments of the functional part may also be envisaged, depending on the respective application of the bristled-ware.

In order to ensure a good connection to the bristle bundle particularly in the case of functional parts which are not comprised of plastic and are not also themselves melted, the functional part may have an undercut at the end facing the bristle bundle. The melted-on plastic material of the bristle bundles in this case flows into the undercut and thus, after cooling and curing, makes a reliable connection to the functional part.

In a further embodiment of the apparatus according to the invention for which independent protection is claimed, an action element made from silica glass, glass ceramic and/or an alloy thereof for acting upon bristle ends of bristle bundles held in a bundle reception plate is provided, a counterabutment element for acting upon the free bundle ends facing away from the action element is provided, the counterabutment element and/or the action element being positionable in the bristle longitudinal direction for acting with force upon the bristle bundles, and a heating device for heating the action element and/or the fastening-side bundle ends and for melting on the bristle bundles and a cooling device for cooling the action element and the bristle bundles after the bristle bundles have been melted are provided.

Such an apparatus makes it possible to melt on the fastening-side bristle bundles so that, for example, in a subsequent work step, plastic material can be injection-molded around them to form a bristle body. In this case, the fastening-side bundle ends can be acted upon by the action element, while a heating device is operated in the region of the action element and the bristle bundles are thus heated by the heat energy penetrating the action element and are melted. It is also possible, however, to heat the fastening-side bundle ends directly and only then to bring up the action element to the heated and melted-on bundle ends and act upon these.

As a result of subsequent cooling, the bundle ends bearing against the action element are cooled until they are completely solidified. Cooling is conducive to the positive separation behavior between the action element and the melted-on bundle ends. Adhesions of bundle material to the action element are avoided as a result of the material properties of the action element which are the same as in the reception sleeve described above. Only one element acting upon the bristle bundles is present, thus making it possible to have a simple mechanical set-up of the apparatus.

In this case, in one embodiment, the bundle reception plate and the action element are arranged so as to be spaced apart from one another, and the action element can be brought nearer to the bundle reception plate for acting upon the heated bristle bundles and for forming these. The action element is in this case pressed against the heated and melted-on bristle bundles projecting beyond the bundle reception plate, so that the free bundle ends are pressed flat to form mushroom heads.

In another embodiment, a carrier plate with through orifices for the bristle bundles is provided between the bundle reception plate and the action element, the through orifices of the carrier plate have a broadened tie cavity in each case at their end facing the action element, and the counterabutment element is positionable in the longitudinal direction of the bristle bundles for acting with force upon the bristle bundles.

By the use of the counterabutment element, the bristle bundles are pressed against the action element, in the region of which the heating device is arranged, with the result that the fastening-side bundle ends are melted. In this case, the melted-on bristle material is pressed into the tie cavities, so as to form on the bristle bundles, on the fastening side, ties which are comprised of formed bristle material which hold the bristle bundles in the carrier plate.

Here, too, a neat separation of the bundle ends from the action element is assisted by subsequent cooling by the cooling device.

In order to prevent the bristle bundles from being melted together with the carrier plate, the material of the bristle bundles should have a markedly lower melting point than the material of the carrier plate. It is also possible, however, to use materials with similar melting points, if a connection of the bristle bundles to the carrier plate during the melting-on operation is desired. This may be expedient, for example, when the carrier plate having the bristle bundles is to be used as a replacement head of a toothbrush. In that case, no further work steps are necessary in order to fasten the bristle bundles to the carrier plate.

By the carrier plate being acted upon by the action element, a planar outer face with the melted-on bundle ends formed into ties is produced. This makes it possible in a simple way to insert the carrier plate with the bristle bundles, for example, into a brush head of a replacement-head toothbrush.

The bundle reception plate or the carrier plate may preferably be an insert part for insertion into a mold orifice of an injection mold. This makes simple further processing of the bristle bundles possible, the bundle reception plate being a reusable mold part, while a carrier plate is itself injection-molded around to form a brush body and therefore becomes part of the finished brush.

The carrier plate may also have marginal fastening noses, by which it is snapped into a receptacle of a brush body. If appropriate, welding by an ultrasonic or high-frequency method may also take place in order to ensure a firm connection between the brush body and carrier part.

To produce brushes having profiled bristle fields, the counterabutment element may have a profiling on its side acting upon the bristle bundles. The individual bristle bundles are then brought into appropriate positions before their connection-side ends are melted, so that the free bundle ends are oriented and positioned according to the desired profiling of the bristle field. Post-machining of the bristle field, for example by the grinding of the bristle bundles, is consequently unnecessary.

The use of silica glass, crystal glass, glass ceramic and/or an alloy thereof for the action element avoids the adhesion of bristle material after cooling. When the action element is withdrawn in the bundle longitudinal direction, it could happen that, for example as a result of adhesive forces, individual bristle bundles are displaced in the longitudinal direction out of their position in the bundle reception plate. In order to avoid this reliably, it is expedient if the action element is positionable transversely to the bristle longitudinal direction between a working position acting upon the bristle bundles and a position of readiness offset with respect to this and releasing the bristle bundles. By the action element being removed at right angles to the bundle longitudinal direction, axial displacement of the bristle bundles is reliably avoided.

The heating device may have, in particular, an infrared heat emitter, a hot-air blower, a laser, a high-frequency transmitter or a heat pulse transmitter. In the case of a heat pulse transmitter, metal is heated by a current flux. When an infrared lamp is used, care must be taken to ensure that silica glass, crystal glass, glass ceramic and/or the alloy thereof used of the reception sleeve or of the action element possess/possesses suitable transmissivity in the corresponding infrared range.

The bristle material may be, for example, PA, in particular, in the production of toothbrushes, PA6-12, PBT, PP, PE, PVC, PET or SAN.

A bristle bundle is conventionally comprised of a multiplicity of individual filaments. Particularly for industrial brushes, however, a monofilament may also be used. The bristle bundle is comprised in this special case of a single filament.

The bristle bundles or their individual filaments may at their free ends be pointed, rounded, spliced, provided with chemical additives or given color markings.

The bristle bundles or their individual filaments may have a round, oval, angular or star-shaped contour.

With regard to the method for the production of brushes or bristled-wares having bristle bundles melted at a fastening-side end, the invention is defined in that a bristle bundle, on the one hand, and a functional part, on the other hand, arranged one behind the other in the longitudinal direction of the bristle bundle, are introduced into a reception sleeve made from silica glass, crystal glass, glass ceramic and/or an alloy thereof, in that heat is delivered to the reception sleeve, at least in the contact region of the bristle bundle and of the functional part, for melting on the bristle bundle, and in this case the bristle bundle and the functional part are pressed one onto the other under the action of force, and in that cooling subsequently takes place in the region of the reception sleeve.

In this case, the advantages already explained in the description of the apparatus according to the invention are afforded.

The invention relates, furthermore, to a brush or bristled-wares having bristle bundles melted together at a fastening-side end. This is defined, according to the invention, in that the bristle bundles are connected, bead-free, to a functional part on the fastening side by a melt connection.

The functional part may in this case be comprised, in particular, of plastic, wood or metal or else of any other solid material. For example, the functional part may be a stick as a grip, a drill, a compression spring or a screw. For an especially reliable connection between the bristle bundle and functional part, particularly when the latter is not comprised of plastic material, the functional part may have an undercut at the end facing the bristle bundle.

In a further embodiment of a brush or bristled-ware according to the invention, for which independent protection is claimed, the bristle bundles are mounted in a carrier plate with through orifices for the bristle bundles, the through orifices of the carrier plate having a broadened tie cavity in each case at their end facing away from the useful end of the bristle bundles, and the bristle bundles having in each case an end portion which is enlarged by melting on and fills the tie cavity and which is arranged within the outer contour of the carrier plate.

BRIEF DESCRIPTION OF THE DRAWINGS

Exemplary embodiments of the apparatus and of the method according to the invention are explained in more detail below in conjunction with the drawings in which, sometimes in a relatively high diagrammatic manner, FIG. 1 shows a reception sleeve with a bristle bundle and with a functional part, FIG. 2 shows the reception sleeve from FIG. 1 with an inserted bristle bundle and functional part, FIG. 3 shows the arrangement from FIG. 2 with an action element for the bristle bundles and with a heating device, FIG. 4 shows the reception sleeve with a cooling device, FIG. 5 shows the bristled-ware extracted from the reception sleeve.

DETAILED DESCRIPTION OF THE PREFERRED EMBODIMENTS

Figure 6:
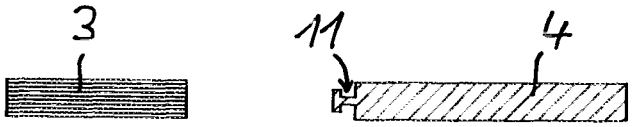
FIG. 6 to FIG. 13 show in each case a bristle bundle and a functional part respectively before and after the connection of the parts to one another.

An apparatus, designated as a whole by 1*a*, for the production of brushes or bristled-wares, which is diagrammatically illustrated in FIGS. 1 to 4 in only very greatly simplified form and only with the elements essential to the invention, has according to FIG. 1 a reception sleeve 2, into which in each case a bristle bundle 3, on the one hand, and a functional part 4, on the other hand, can be introduced. The reception sleeve 2 is dimensionally adapted in its inner cross section to the outer contour of the bristle bundle 3, so that the bristle bundle 3 inserted into the reception sleeve 2 is surrounded positively by the reception sleeve 2 (FIG. 2). The reception sleeve 2 may preferably have a round inner cross section for the reception of round bristle bundles 3. However, other cross sections are also possible according to the respective bundle contour, for example rectangular, oval or star-shaped.

A functional part 4 with a corresponding contour is introduced into the reception sleeve 2 from the other side, so that the bristle bundle 3 and the functional part 4 are in contact with one another within the reception sleeve 2.

For the simplified introduction of the bristle bundle 3 and of the functional part 4, the reception sleeve 2 has an introduction chamfer 5 at each of its longitudinal-side ends (FIG. 1).

The reception sleeve 2 is comprised of silica glass, crystal glass, glass ceramic and/or an alloy thereof, so that it has high transmissivity for heat radiation and low conductivity for contact heat.

According to FIG. 3, the bundle-side end of the reception sleeve 2 is closed off by an action element 6 and force is exerted upon the functional part 4 by a further action element, not illustrated and indicated merely by the arrow Pf1, so that the bristle bundle 3 and the functional part 4 are pressed one onto the other. At the same time, by a heating device 7 brought nearer to the reception sleeve 2, the region around the contact point between the bristle bundle 3 and functional part 4 is heated and the bristle material is thereby melted together in this region, so that it can be connected to the functional part 4. If the functional part 4, too, is made from plastic and has a similar melting point to the bristle material, this, too, is melted and the connection between the bristle bundle 3 and functional part 4 is improved.

Since the bristle bundle 3 and the functional part 4 are arranged positively in the reception sleeve 2, the molten plastic material cannot escape laterally beyond the bundle contour, so that no lateral bead occurs on the finished bristled-ware 9 (FIG. 5) in the region 10 at which the bristle bundle 3 has been melted.

Moreover, the material of the reception sleeve 2 does not generate any unpleasant plastic smells during the melting-on operation.

By virtue of the thermal properties of the reception sleeve 2, the heat energy of the heating device 7 can penetrate effectively into the inner space of the reception sleeve 2 and melt the bristle material.

After the melting-on operation, the reception sleeve 2 and the bristle bundle 3 located therein, together with the functional part 4 consequently connected, are cooled (FIG. 4) by a cooling device 8. Since the reception sleeve 2, because of its material properties, has a negative coefficient of expansion contrary to the melted-on plastic material, the plastic easily comes loose from the reception sleeve 2 during the cooling phase, so that the finished bristled-ware 9 comprised of the bristle bundle 3 and of the functional part 4 can be drawn out of the reception sleeve 2 in a simple way. This is also assisted by the smooth pore-free surface of the reception sleeve 2.

Figure 7:
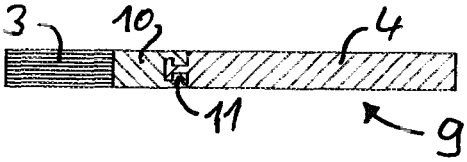

FIG. 6 shows a bristle bundle 3 and a functional part 4 which is to be connected thereto and which is likewise of stick-shaped form and has an undercut 11 at its connection-side end facing the bristle bundle 3. When the plastic material of the bristle bundle 3 is being melted, the melt flows into the region of the undercut 11 (FIG. 7), so that an especially good connection between the bristle bundle 3 and functional part 4 is formed.

Figure 8:
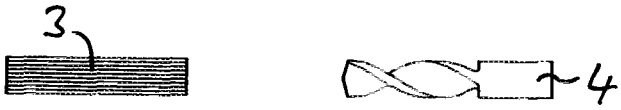
Figure 9:
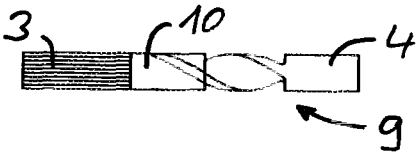

In FIGS. 8 and 9, the functional part 4 is a twist drill. The melted-on plastic material flows into the region of the drill tip, thus likewise making it possible to have a good connection. The bristled-ware 9 according to FIG. 9 may be, for example, a grinding or polishing brush which can be fastened to a drilling machine by the drill, in order to grind or polish a surface using the bristle bundle 3.

Figure 10:
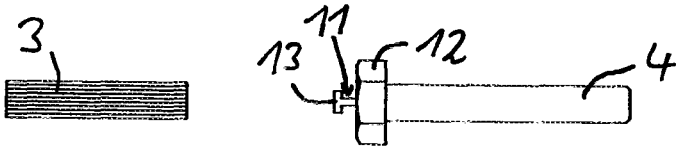
Figure 11:
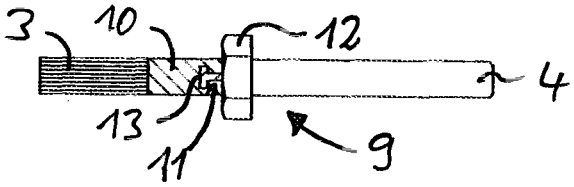

According to FIGS. 10 and 11, the functional part 4 is designed as a screw with a hexagon head 12. When the functional part 4 is connected to the bristle bundle 3, in this case the reception sleeve, not illustrated here, stands on that end face of the hexagon head 12 which faces the bristle bundle 3. For improved connection to the bristle bundle 3, a projection 13 with an undercut 11 is provided on this end face. A bristled-ware 9 according to FIG. 11 can, for example, be screwed to a carrier and be exchanged in a simple way after the bristle bundle 3 has become worn.

Figure 12:
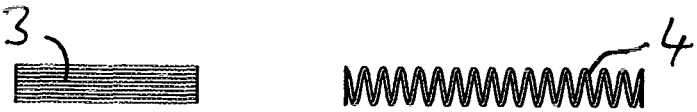
Figure 13:
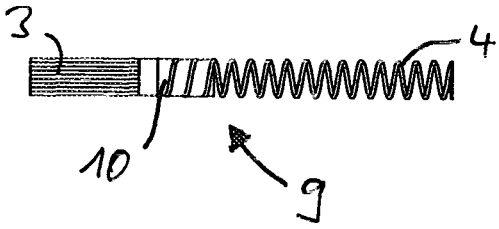
Figure 14:
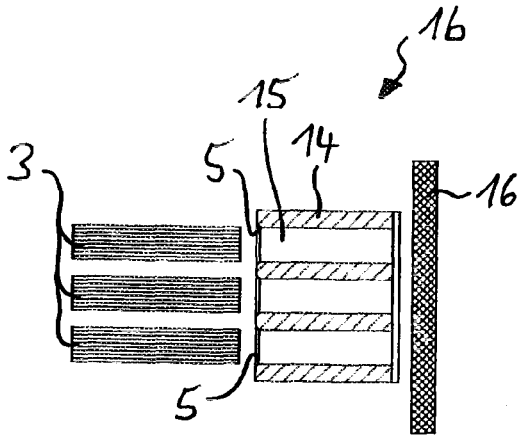
FIG. 14 to FIG. 17 show different method sections in the melting on of bristle bundles, held in a bundle reception plate, by an apparatus according to the invention.

FIGS. 12 and 13 show a further variant in which a bristle bundle 3 is connected to a functional part 4 designed as a compression spring, so as to form a bristled-ware 9. When the two parts are connected, the melted-on plastic material of the bristle bundle 3 flows into the helical turns of the functional part 4 or the functional part 4 is pressed into the melted-on connection region 10. In this case, too, a good connection between the bristle bundle 3 and functional part 4 is formed after the cooling and solidification of the plastic material.

FIGS. 14 to 17 show, likewise in a highly diagrammatic manner, a further embodiment of an apparatus 1*b* according to the invention for the production of brushes or bristled-wares. In this apparatus 1*b*, according to FIG. 14, bristle bundles 3 are introduced into through orifices 15 of a bundle reception plate 14. The bundle reception plate 14 has in each case an introduction chamfer 5 at the introduction-side ends of the through orifices 15 for the simplified introduction of the bristle bundles 3. The fitting of the bundle reception plate 14 with bristle bundles 3 may also take place beforehand, outside the apparatus 1*b*, and the bundle reception plate 14 fitted with bristle bundles 3 is then delivered to the apparatus 1*b*.

Figure 15:
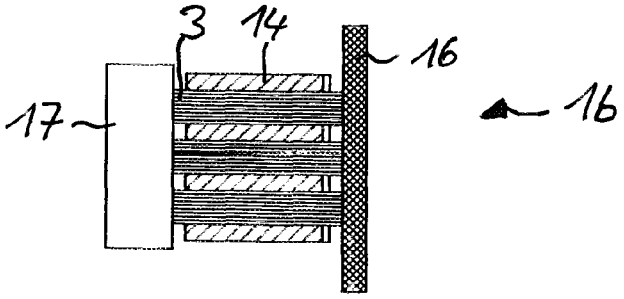

As can be seen clearly in FIG. 15, the bundle reception plate 14 is positioned so as to be spaced apart from an action element 16, the bristle bundles 3 projecting beyond the bundle reception plate 14 and butting against the action element 16. The free bundle ends facing away from the action element 16 are acted upon by a counterabutment element 17 and are thereby held in position.

Similarly to the reception sleeve 2 of the apparatus 1*a* according to FIGS. 1 to 4, the action element 16 acting upon the bristle bundles 3 is comprised of silica glass, crystal glass, glass ceramic and/or an alloy thereof and therefore likewise has the above-described properties with regard to thermal conductivity, coefficient of expansion and surface quality.

Figure 16:
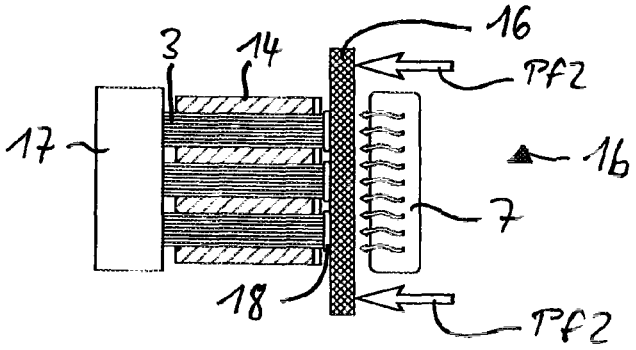
Figure 17:
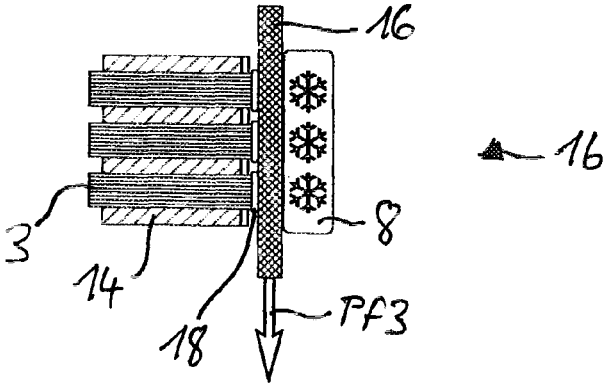
Figure 18:
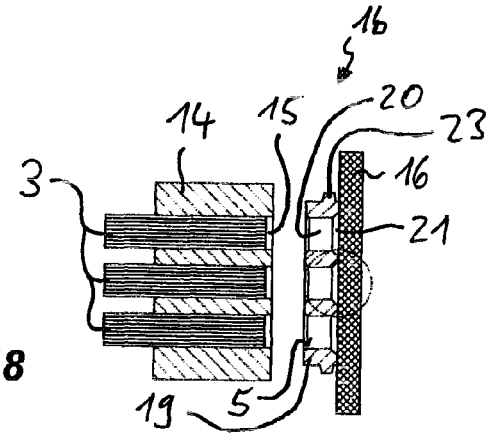
FIG. 18 to FIG. 23 show different method sections in the melting on of bristle bundles, held in a bundle reception plate and a carrier plate, by an apparatus according to the invention.
Figure 19:
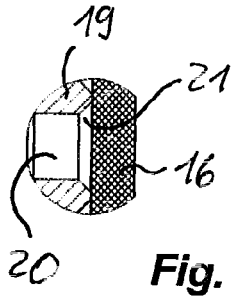
Figure 20:
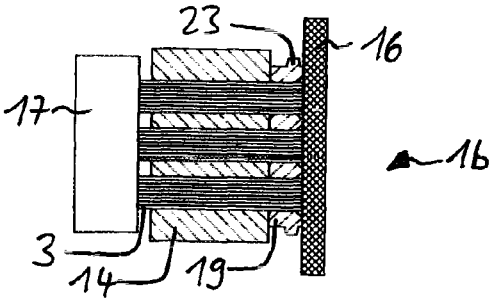
Figure 21:
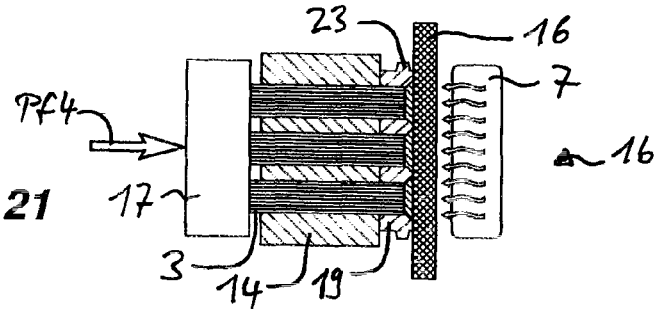
Figure 22:
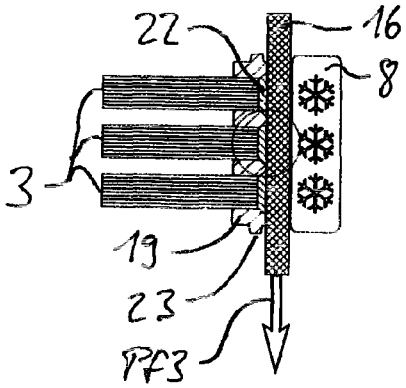

According to FIG. 16, the bundle ends bearing against the action element 16 are heated by a heating device 7 and melted, and at the same time the action element 16 is brought nearer to the bundle reception plate 14 (arrows Pf2). The melted-on bundle ends, projecting beyond the bundle reception plate 14, of the bristle bundles 3 are thereby formed into mushroom heads 18.

After the forming of the bundle ends, the plastic material is cooled with the aid of a cooling device 8 (FIG. 17) and cured. The active cooling by the cooling device 8 is conducive to the separation behavior between the action element 16 and bristle bundles 3.

Subsequently, according to the arrow Pf3, the action element 16 is removed transversely to the bristle longitudinal direction. Removal transversely to the bristle longitudinal direction reliably avoids the situation where individual bristle bundles 3 are displaced in the longitudinal direction and are drawn out of the bundle reception plate 14. The bundle reception plate 14 with the bristle bundles 3 which then have bundle ends formed into mushroom heads 18 can be inserted as a mold part into an injection mold and the mushroom heads 18 can be injection-molded around to form a brush body, in this case the work can be carried out with a high injection pressure by the mushroom heads 18, without the risk of over injections in the region of the bristle bundles 3.

The counterabutment element 17 acting upon the free ends of the bristle bundles 3 may also have a profiling, by which the bristle bundles 3 can be profiled according to a desired profiling of the bristle field of the finished brush.

FIGS. 18 to 23 illustrate an apparatus 1*b* which is similar to the Apparatus 1*b* from FIGS. 14 to 17. However, in addition, a carrier plate 19 is provided between the bundle reception plate 14 and the action element 16. This carrier plate 19 has through orifices 20 for the bristle bundles 3, introduction chamfers 5 being provided on the introduction side at the through orifices 20. The carrier plate 19 bears against the action element 16. At their ends facing the action element 16, the through orifices 20 have in each case a broadened tie cavity 21 which can be seen clearly in the illustration in the form of a detail according to FIG. 19.

The free bundle ends are acted upon (FIG. 20) by a counterabutment element 17. The counterabutment element 17 is moved (FIG. 21) in the direction of the action element 16 according to the arrow Pf4, while the bundle ends bearing against the action element 16 are heated by a heating device 7 and melted. Here, too, the heat energy of the heating device 7 is conducted effectively through the action element 16 made from silica glass, crystal glass, glass ceramic and/or an alloy thereof. As a result of pressure upon the bristle bundles 3, the melted-on plastic material escapes into the tie cavities 21 and fills these.

Here, too, cooling is subsequently carried out (FIG. 22) by a cooling device 8, in order to accelerate the cooling and curing of the plastic material and improve the separation properties between the plastic material and the action element 16.

Figure 23:
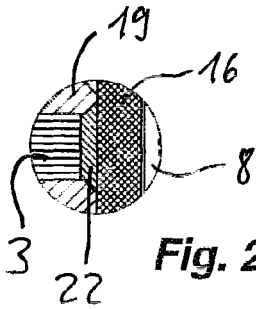

FIG. 23 shows an illustration in the form of a detail of a tie cavity 21 of the carrier plate 19, said tie cavity being filled with plastic material of a melted-on bristle bundle 3. The fastening-side bundle ends formed into a tie 22 improve the hold of the bristle bundles 3 in the carrier plate 19. Correspondingly to FIG. 17, according to FIG. 22 the action element 16 can be removed (arrow Pf4) from the carrier plate 19 transversely to the bristle longitudinal direction after the curing of the plastic material.

The carrier plate 19 can be inserted into an injection mold and be injection-molded around to form a brush body. It is also possible to insert the carrier plate 19 into a reception orifice of a prefabricated brush body. A latching or snap-like connection can be made by lateral fastening noses 23. The further processing of the carrier plate 19 having the bristle bundles 3 held in it is also simplified in that the fastening-side ends of the bristle bundles 3 with the ties 22 in the tie cavities 21 do not project beyond the outer contour of the carrier plate 19, but instead terminate flush with this.

The invention claimed is:

1. An apparatus (1*a*) for the production of brushes or bristled-wares (9) having bristle bundles (3) melted at a fastening-side end, the apparatus comprising: a reception sleeve (2) made from at least one of silica glass, crystal glass, glass ceramic, or an alloy thereof that is provided for a positive reception of a bristle bundle (3) at least in a region to be melted, a functional part (4) arranged behind the fastening-side end of the bristle bundle in the reception sleeve in a bristle longitudinal direction, action elements (6) for acting upon free ends of the bristle bundle (3) and the functional part (4) and for acting with force upon at least one of the bristle bundle (3) or the functional part (4) in the bristle longitudinal direction, a heating device (7), arranged outside the reception sleeve (2), for heating mutually confronting ends of the bristle bundle (3) and of the functional part (4) to melt on the bristle bundle (3), and a cooling device (8), arranged outside the reception sleeve (2), for cooling a previously melted-on bristle bundle (3).

2. The apparatus as claimed in claim 1, wherein the functional part (4) is comprised of at least one of plastic, wood or metal.

3. The apparatus as claimed in claim 1, wherein the functional part (4) is a stick, a drill, a compression spring or a screw.

4. The apparatus as claimed in claim 1, wherein the functional part (4) has an undercut (11) at an end facing the bristle bundle (3).

5. The apparatus as claimed in claim 1, wherein the heating device (7) has an infrared heat emitter, a hot-air blower, a laser, a high-frequency transmitter or a heat pulse transmitter.

6. The apparatus as claimed in claim 1, wherein the bristle bundles (3) are comprised of individual filaments, and at least one of the bristle bundles or the individual filaments thereof have at least one of pointed free ends, rounded free ends, are spliced, are provided with chemical additives or have color markings.

7. The apparatus as claimed in claim 1, wherein the bristle bundles (3) are comprised of individual filaments, and at least one of the bristle bundles or the individual filaments thereof have a round, oval, angular or star-shaped contour.

8. A method for the production of brushes or bristled-wares (9) having bristle bundles (3) melted at a fastening-side end, comprising:

introducing a bristle bundle (3) and a functional part (4) arranged one behind the other in a longitudinal direction of the bristle bundle (3) into a reception sleeve (2) made from at least one of silica glass, crystal glass, glass ceramic, or an alloy thereof, heating the reception sleeve (2) with a heating device arranged outside of the reception sleeve, at least in a contact region of the bristle bundle (3) and of the functional part (4), melting the bristle bundle (3) on the functional part (4), with the bristle bundle (3) and the functional part (4) being pressed one onto the other under by action elements (6) for acting upon free ends of the bristle bundle (3) and the functional part (4) that act with force upon at least one of the bristle bundle (3) or the functional part (4) in the bristle longitudinal direction, and subsequently cooling at least a region of the reception sleeve (2) with a cooling device (8), arranged outside the reception sleeve (2).

* * * * *